US009690224B2

(12) United States Patent
Nishitera

(10) Patent No.: US 9,690,224 B2
(45) Date of Patent: Jun. 27, 2017

(54) ELECTROSTATIC LATENT IMAGE DEVELOPING TONER

(71) Applicant: KYOCERA Document Solutions Inc., Osaka (JP)

(72) Inventor: Haruhiro Nishitera, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/162,013

(22) Filed: May 23, 2016

(65) Prior Publication Data

US 2016/0349650 A1 Dec. 1, 2016

(30) Foreign Application Priority Data

May 27, 2015 (JP) ..... 2015-107503

(51) Int. Cl.
*G03G 9/00* (2006.01)
*G03G 9/093* (2006.01)
*G03G 9/097* (2006.01)

(52) U.S. Cl.
CPC ..... *G03G 9/09371* (2013.01); *G03G 9/0975* (2013.01); *G03G 9/09321* (2013.01); *G03G 9/09741* (2013.01)

(58) Field of Classification Search
CPC ..... G03G 9/09371; G03G 9/09321; G03G 9/09741; G03G 9/0975
See application file for complete search history.

(56) References Cited

U.S. PATENT DOCUMENTS 5,656,759 A * 8/1997 Ito ..... B41M 5/385 544/103
6,355,720 B1 * 3/2002 Canard ..... C08F 257/02 523/201
2010/0055599 A1 * 3/2010 Yang ..... G03G 9/0804 430/110.2

FOREIGN PATENT DOCUMENTS

JP 2006-091081 A 4/2006

* cited by examiner

*Primary Examiner* — Thorl Chea
(74) *Attorney, Agent, or Firm* — Studebaker & Brackett PC

(57) ABSTRACT

An electrostatic latent image developing toner contains a plurality of toner particles. Each of the toner particles contains, in a surface portion thereof, at least one hydrophobic salt in a state where a cation derived from a first surfactant is ionically bonded to an anion derived from a second surfactant. A ratio of a total mass of the at least one hydrophobic salt to a mass of the toner is 1 ppm or more and 5,000 ppm or less.

11 Claims, No Drawings

ELECTROSTATIC LATENT IMAGE DEVELOPING TONER

INCORPORATION BY REFERENCE

The present application claims priority under 35 U.S.C. §119 to Japanese Patent Application No. 2015-107503, filed on May 27, 2015. The contents of this application are incorporated herein by reference in their entirety.

BACKGROUND

The present disclosure relates to an electrostatic latent image developing toner.

A surfactant is sometimes used in production of an electrostatic latent image developing toner. Such a surfactant is generally hydrophilic, and hence is liable to be a cause of degradation in charge stability of the toner. Besides, a technique to hydrophobize the surface of a toner particle by causing a surfactant having a hydrophobic group to adhere, in water, to the surface of the toner particle is already known.

SUMMARY

An electrostatic latent image developing toner of the present disclosure contains a plurality of toner particles. Each of the toner particles contains, in a surface portion thereof, at least one hydrophobic salt in a state where a cation derived from a first surfactant is ionically bonded to an anion derived from a second surfactant. A ratio of a total mass of the at least one hydrophobic salt to a mass of the toner is 1 ppm or more and 5,000 ppm or less.

DETAILED DESCRIPTION

A preferred embodiment of the present invention will now be described in detail. It is noted that an evaluation result (i.e., a value corresponding to the shape, physical property or the like) of a powder (more specifically, toner cores, toner mother particles, an external additive, a toner, or the like) is, unless otherwise specified, a number average of values measured for an appropriate number of average particles selected from the powder.

A number average particle size of a powder is, unless otherwise specified, a number average of circle equivalent diameters (i.e., diameters of circles each having the same area as a projected area of a particle) of primary particles measured with a microscope. Besides, a measured value of a volume median diameter ($D_{50}$) of a powder is, unless otherwise specified, a value obtained through measurement with a laser diffraction/scattering particle size analyzer ("LA-750" manufactured by Horiba, Ltd.). Furthermore, a measured value of each of an acid value and a hydroxyl value is, unless otherwise specified, a value measured in accordance with "JIS (Japanese Industrial Standards) K0070-1992". In addition, a measured value of each of a number average molecular weight (Mn) and a mass average molecular weight (Mw) is, unless otherwise specified, a value obtained through measurement by gel permeation chromatography.

Here, the term "-based" following the name of a compound is used in some cases for comprehensively referring to the compound and derivatives thereof. If the term "-based" following the name of a compound is used for designating a polymer, it means that a repeating unit of the polymer is derived from the compound or a derivative thereof. Besides, the term "(meth)acrylic" is used in some cases for comprehensively referring to acrylic and methacrylic.

A toner according to the present embodiment can be suitably used for developing an electrostatic latent image as, for example, a positively chargeable toner. The toner of the present embodiment is a powder containing a plurality of particles (each of which has features described later). The toner may be used also as a one-component developer. Alternatively, the toner may be mixed with a carrier by using a mixer (such as a ball mill) to prepare a two-component developer. In order to form a high quality image, a ferrite carrier is preferably used as the carrier. Furthermore, in order to form high quality images over a long period of time, magnetic carrier particles each including a carrier core, and a resin layer coating the carrier core are preferably used. For magnetizing carrier particles, the carrier cores may be made of a magnetic material, or magnetic particles may be dispersed in the resin layer. In order to form a high quality image, the content of the toner in the two-component developer is preferably 5 parts by mass or more and 15 parts by mass or less, more preferably 8 parts by mass or more and 12 parts by mass or less based on 100 parts by mass of the carrier. It is noted that the positively chargeable toner contained in the two-component developer is positively charged through friction with the carrier.

The toner according to the present embodiment can be used, for example, for forming an image in an electrophotographic apparatus (an image forming apparatus). Now, an example of an image forming method performed by an electrophotographic apparatus will be described.

First, an electrostatic latent image is formed on a photosensitive member (such as a surface portion of a photosensitive drum) on the basis of image data. Next, the formed electrostatic latent image is developed by a developer containing a toner. In the development process, the charged toner is allowed to adhere to the electrostatic latent image to form a toner image on the photosensitive member. In a subsequent transfer process, the toner image is transferred onto an intermediate transfer member (such as a transfer belt), and then, the toner image having been transferred onto the intermediate transfer member is transferred further to a recording medium (such as paper). Thereafter, the toner is heated to be fixed on the recording medium. As a result, an image is formed on the recording medium. If toner images of, for example, four colors of black, yellow, magenta, and cyan are superimposed, a full-color image can be formed.

The toner of the present embodiment is an electrostatic latent image developing toner having the following features (hereinafter referred to as the basic features).

(Basic Features of Toner)

Each toner particle contains, in a surface portion thereof, at least one hydrophobic salt in a state where a cation derived from a first surfactant is ionically bonded to an anion derived from a second surfactant. A ratio of a total mass of the at least one hydrophobic salt to a mass of the toner (hereinafter referred to as the hydrophobic salt content) is 1 ppm or more and 5,000 ppm or less. It is noted that a surfactant is a compound having a hydrophilic group and a hydrophobic group in a molecule. The hydrophobic salt is a salt in a state where a hydrophilic group of the first surfactant is ionically bonded to a hydrophilic group of the second surfactant. A hydrophobic salt content of 1 ppm means that 0.001 mg of the hydrophobic salt is contained in 1 g of the toner. The term "total mass of the at least one hydrophobic salt" means, if the toner contains merely one hydrophobic salt, the mass of the contained hydrophobic salt, and if the toner contains two or more hydrophobic salts, it means a sum of the masses of all the contained hydrophobic salts. The hydrophobic salt content can be measured by a method described in examples below or alternative method thereof.

An example of the first surfactant includes distearyl dimethyl ammonium chloride. The distearyl dimethyl ammonium chloride is represented by the following formula (1):

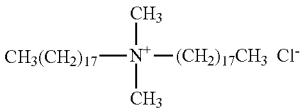

(1)

An example of the second surfactant includes sodium lauryl sulfate. The sodium lauryl sulfate is represented by the following formula (2):

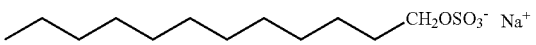

(2)

An example of the hydrophobic salt includes a compound in a state where a cation resulting from removing a chloride ion ($Cl^-$) from the distearyl dimethyl ammonium chloride represented by formula (1) (namely, a distearyl dimethyl ammonium cation) and an anion resulting from removing a sodium ion (Nat) from the sodium lauryl sulfate represented by formula (2) (namely, a lauryl sulfate anion) are ionically bonded to each other. More specifically, the hydrophobic salt is synthesized by ionically bonding a quaternary ammonium cation ($N^+$) of the distearyl dimethyl ammonium cation to a sulfate anion group ($—OSO_3^-$) of the lauryl sulfate anion.

In the toner having the above-described basic features, each toner particle contains the hydrophobic salt in the surface portion. The hydrophobic salt can be synthesized in the surface portion of the toner particle by, for example, ionically bonding the second surfactant to the first surfactant adhering to the surface of the toner particle. Also in a case where a first surfactant having water solubility is used in the production of the toner, the hydrophobicity of the surface of the toner particle can be enhanced by ionically bonding the first surfactant to the second surfactant.

The hydrophilicity on the surface of a toner particle can be weakened also by removing a surfactant adhering to the surface of the toner particle. In order to sufficiently remove the surfactant merely by washing, however, great labor is required. In the toner having the above-described features, it is presumed that the surface of the toner particle can be easily and properly hydrophobized by synthesizing the hydrophobic salt on the surface of the toner particle.

In the toner having the above-described features, the hydrophobic salt content is 1 ppm or more and 5,000 ppm or less. It is presumed that if the hydrophobic salt content is too small, the surface of the toner particle cannot be sufficiently hydrophobized. On the other hand, if the hydrophobic salt content is too large, the viscosity of the surface of the toner particle under a high temperature environment is increased, and hence high-temperature preservability of the toner is liable to be degraded. In order to inhibit charge decay of the toner under a high humidity environment while attaining both the high-temperature preservability and low-temperature fixability of the toner, the hydrophobic salt content is more preferably 1 ppm or more and 1,000 ppm or less.

Each toner particle contained in the toner may be a toner particle having no shell layer (hereinafter referred to as the non-capsule toner particle), or a toner particle having a shell layer (hereinafter referred to as the capsule toner particle). The basic features are, however, particularly beneficial if each toner particle contained in the toner is the capsule toner particle. In the embodiment herein described, each toner particle contained in the toner is assumed as the capsule toner particle.

Each of the toner particles (the capsule toner particles) contained in the toner of the present embodiment includes a core (hereinafter referred to as the toner core), and a shell layer (a capsule layer) disposed over the surface of the toner core. The shell layer is substantially made of a resin. An external additive may be caused to adhere to the surface of the toner core or the shell layer. The shell layer may cover the whole surface of the toner core, or may partially cover the surface of the toner core. Alternatively, a plurality of shell layers may be stacked on the surface of the toner core. The external additive may be omitted if not needed. Hereinafter, a toner particle obtained before causing the external additive to adhere thereto is referred to as a toner mother particle. Besides, a material used for forming the shell layer is referred to as a shell material. In a non-capsule toner particle, the toner core of the capsule toner described later can be used as the toner mother particle.

In order to attain both the high-temperature preservability and the low-temperature fixability of the toner, the shell layer covers preferably 50% or more and 99% or less, and more preferably 70% or more and 95% or less of the surface area of each toner core. In order to attain both the high-temperature preservability and the low-temperature fixability of the toner, the shell layer has a maximum thickness of preferably 100 nm or less. If the toner particles contained in the toner are the capsule toner particles, the surface portion of each toner particle mentioned in the basic features corresponds to a surface portion of the toner core in a region on the surface of the toner particle where the surface of the toner core is not covered with the shell layer (hereinafter referred to as the exposed region), and corresponds to a surface portion of the shell layer in a region on the surface of the toner particle where the surface of the toner core is covered with the shell layer (hereinafter referred to as the covered region). In each of the capsule toner particles, the hydrophobicity of the surface of the toner particle can be increased by allowing the surface portion of the shell layer in the covered region of the toner particle to contain the hydrophobic salt. Besides, if the toner core contains a polyester resin, the hydrophilicity of the surface of the toner particle is liable to be enhanced when the polyester resin is exposed in the exposed region of the toner particle. Since the surface portion of the toner core contains the hydrophobic salt in the exposed region of the toner particle, however, the hydrophobicity of the surface of the toner particle can be enhanced.

In order to attain both the high-temperature preservability and the low-temperature fixability of the toner, the volume median diameter ($D_{50}$) of the toner is preferably 1 μm or more and less than 10 μm. Incidentally, the volume median diameter ($D_{50}$) is measured by a method described in the examples below or alternative method thereof.

Next, the toner core (including a binding resin and an internal additive), the shell layer, the hydrophobic salt, and the external additive will be successively described. A component not necessary depending on the use of the toner may be appropriately omitted. Suitable examples of resins that can be used to produce the toner are listed below.

<Preferable Thermoplastic Resins>

Preferable examples of thermoplastic resins include styrene-based resins, acrylic acid-based resins (more specifically, a polymer of acrylic acid ester and a polymer of methacrylic acid ester), olefin-based resins (more specifically, polyethylene resins and polypropylene resins), vinyl chloride resins, polyvinyl alcohols, vinyl ether resins, N-vinyl resins, polyester resins, polyamide resins, and urethane resins. Also, a copolymer of any of these resins, specifically a copolymer of any of the resins into which an optional repeating unit is introduced (more specifically, styrene-acryl acid-based resins and styrene-butadiene-based resins) may be preferably used.

A thermoplastic resin can be obtained through addition polymerization, copolymerization, or condensation polymerization of at least one of thermoplastic monomers. Note that a thermoplastic monomer is a monomer that is to become a thermoplastic resin through homopolymerization (more specifically, an acrylic acid-based monomer or a styrene-based monomer), or a monomer that is to become a thermoplastic resin through condensation polymerization (such as a combination of a polyhydric alcohol and a polycarboxylic acid that is to become a polyester resin through condensation polymerization).

A styrene-acrylic acid-based resin is a copolymer of at least one styrene-based monomer and at least one acrylic acid-based monomer. Styrene-based monomers and acrylic acid-based monomers mentioned below can be suitably used for synthesizing the styrene-acrylic acid-based resin. When an acrylic acid-based monomer having a carboxyl group is used, the carboxyl group can be introduced into the styrene-acrylic acid-based resin. Furthermore, when a monomer having a hydroxyl group (more specifically, p-hydroxystyrene, m-hydroxystyrene, and (meth)acrylic acid hydroxyalkyl ester) is used, the hydroxyl group can be introduced into the styrene-acrylic acid-based resin. When the amount of the acrylic acid-based monomer is adjusted, the acid value of the resultant styrene-acrylic acid-based resin can be controlled. When the amount of the monomer having a hydroxyl group is adjusted, the hydroxyl value of the resultant styrene-acrylic acid-based resin can be controlled.

Preferable examples of the styrene-based monomers include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Preferable examples of the acrylic acid-based monomer include (meth)acrylic acids, (meth)acrylic acid alkyl esters, and (meth)acrylic acid hydroxyalkyl esters. Preferable examples of the (meth)acrylic acid alkyl esters include methyl (meth)acrylate, ethyl (meth)acrylate, n-propyl (meth)acrylate, isopropyl (meth)acrylate, n-butyl (meth) acrylate, isobutyl (meth)acrylate, and 2-ethylhexyl (meth) acrylate. Preferable examples of the (meth)acrylic acid hydroxyalkyl esters include 2-hydroxyethyl (meth)acrylate, 3-hydroxypropyl (meth)acrylate, 2-hydroxypropyl (meth) acrylate, and 4-hydroxybutyl (meth)acrylate.

A polyester resin can be prepared through condensation polymerization of at least one polyhydric alcohol and at least one polycarboxylic acid. Examples of the alcohol that can be preferably used for synthesizing the polyester resin include dihydric alcohols (more specifically, diols and bisphenols) and tri- or higher-hydric alcohols, as listed below. Examples of the carboxylic acid that can be preferably used for synthesizing the polyester resin include dibasic carboxylic acids and tri- or higher carboxylic acids, as listed below. When the amounts of the alcohol and the carboxylic acid are respectively changed in the synthesis of the polyester resin, the acid value and the hydroxyl value of the polyester resin can be controlled. The acid value and the hydroxyl value of the polyester resin tend to be lowered by increasing the molecular weight of the polyester resin.

Preferable examples of diols include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Preferable examples of bisphenols include bisphenol A, hydrogenated bisphenol A, bisphenol A ethylene oxide adduct, and bisphenol A propylene oxide adduct.

Preferable examples of tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of dibasic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acid (more specifically, n-butylsuccinic acid, isobutylsuccinic acid, n-octylsuccinic acid, n-dodecylsuccinic acid, and isododecylsuccinic acid), and alkenyl succinic acid (more specifically, n-butenylsuccinic acid, isobutenylsuccinic acid, n-octenylsuccinic acid, n-dodecenylsuccinic acid, and isododecenylsuccinic acid).

Preferable examples of tri- or higher carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra (methylenecarboxyl)methane, 1,2,7,8-octanetetracarboxylic acid, pyromellitic acid, and EMPOL trimer acid.

Note that the di-, tri-, or higher carboxylic acids may be deformed into ester-forming derivatives (more specifically, acid halides, acid anhydrides, and lower alkyl esters). The term "lower alkyl" herein is defined as an alkyl group having a carbon number of at least 1 and no greater than 6.

<Preferable Thermosetting Resins>

Preferable examples of thermosetting resins include melamine-based resins, urea-based resins, sulfonamide-based resins, glyoxal-based resins, guanamine-based resins, aniline-based resins, polyimide resins (more specifically, a maleimide polymer and a bismaleimide polymer), and xylene-based resins.

The thermosetting resin can be prepared through cross-linking (polymerization) of at least one thermosetting monomer. When a crosslinking agent is used, the thermosetting resin can be synthesized by a thermosetting monomer. Note that the thermosetting monomer has a cross-linking property. For example, if monomers of the same species are three-dimensionally linked via "—$CH_2$—" to form a thermosetting resin, the monomers and the "thermosetting monomers" are equivalent.

Preferable examples of the thermosetting monomer include methylol melamine, melamine, methylol urea (more specifically, dimethylol dihydroxyethyleneurea), urea, benzoguanamine, acetoguanamine, and spiroguanamine.

[Toner Cores]

The toner cores contain a binder resin. Furthermore, the toner cores may optionally contain an internal additive (for example, a colorant, a releasing agent, a charge control agent, and a magnetic powder).

(Binder Resin)

The binder resin generally constitutes a large proportion (for example, 85% by mass or more) of components of each toner core. Properties of the binder resin are therefore expected to have great influence on the overall property of the toner core. For example, if the binder resin has an ester group, a hydroxyl group, an ether group, an acid group, or a methyl group, the toner core is highly likely to be anionic. If the binder resin has an amino group or an amide group, the toner core is highly likely to be cationic. In order to improve the bonding property (the reactivity) between the toner core and the shell layer, the hydroxyl value and the acid value of the binder resin are preferably 10 mgKOH/g or more, and more preferably 20 mgKOH/g or more.

In order to improve the fixability of the toner in high speed fixing, the binder resin preferably has a glass transition point (Tg) of 20° C. or higher and 55° C. or lower. The glass transition point (Tg) is measured by a method employed in the examples described later or alternative method thereof.

In order to improve the fixability of the toner in the high speed fixing, the binder resin preferably has a softening point (Tm) of 100° C. or lower, and more preferably 95° C. or lower. The softening point (Tm) is measured by a method employed in the examples described later or alternative method thereof. When a plurality of resins having different softening points (Tm) are used in combination, the softening point (Tm) of the binder resin can be controlled.

Thermoplastic resins (more specifically, those mentioned in "Preferable Thermoplastic Resins" above) are preferably used as the binder resin of the toner core. In order to improve dispersibility of a colorant in the toner core, chargeability of the toner, and fixability of the toner to a recording medium, a styrene-acrylic acid-based resin or a polyester resin is particularly preferably used as the binder resin.

If a styrene-acrylic acid-based resin is used as the binder resin of the toner cores, in order to improve strength of the toner cores and fixability of the toner, the styrene-acrylic acid-based resin preferably has a number average molecular weight (Mn) of at least 2,000 and no greater than 3,000. The styrene-acrylic acid-based resin preferably has a molecular weight distribution (a ratio Mw/Mn of a mass average molecular weight (Mw) to the number average molecular weight (Mn)) of at least 10 and no greater than 20. The gel permeation chromatography can be employed for measuring the molecular weights Mn and Mw of the styrene-acrylic acid-based resin.

If a polyester resin is used as the binder resin of the toner cores, in order to improve strength of the toner cores and fixability of the toner, the polyester resin preferably has a number average molecular weight (Mn) of at least 1,000 and no greater than 2,000. The polyester resin preferably has a molecular weight distribution (a ratio Mw/Mn of the mass average molecular weight (Mw) relative to the number average molecular weight (Mn)) of at least 9 and no greater than 21. The gel permeation chromatography can be employed for measuring the molecular weights Mn and Mw of the polyester resin.

(Colorant)

The toner cores may optionally contain a colorant. The colorant can be a known pigment or dye that matches the color of the toner. The amount of the colorant is preferably at least 1 part by mass and no greater than 20 parts by mass, and more preferably at least 3 parts by mass and no greater than 10 parts by mass based on 100 parts by mass of the binder resin in order to form a high-quality image with the toner.

The toner cores may contain a black colorant. Carbon black can be used as the black colorant. The black colorant may be a colorant that is adjusted to a black color using a yellow colorant, a magenta colorant, and a cyan colorant.

The toner core may contain a non-black colorant such as a yellow colorant, a magenta colorant, or a cyan colorant.

The yellow colorant can be at least one compound selected from the group consisting of condensed azo compounds, isoindolinone compounds, anthraquinone compounds, azo metal complexes, methine compounds, and arylamide compounds. Specific examples of the yellow colorant that can be preferably used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

The magenta colorant can be at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of the magenta colorant that can be preferably used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

The cyan colorant can be at least one compound selected from the group consisting of copper phthalocyanine compounds, anthraquinone compounds, and basic dye lake compounds. Specific examples of the cyan colorant that can be preferably used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner cores may optionally contain a releasing agent. The releasing agent is for example used in order to improve the fixability or the offset resistance of the toner. In order to improve anionic strength of the toner cores, the toner cores are preferably prepared using an anionic wax. In order to improve the fixability or the offset resistance of the toner, the amount of the releasing agent is preferably at least 1 part by mass and no greater than 30 parts by mass, and more preferably at least 5 parts by mass and no greater than 20 parts by mass based on 100 parts by mass of the binder resin.

Examples of the releasing agent that can be preferably used include aliphatic hydrocarbon waxes such as low molecular weight polyethylene, low molecular weight polypropylene, a polyolefin copolymer, a polyolefin wax, microcrystalline wax, paraffin wax, and Fischer-Tropsch wax; oxides of aliphatic hydrocarbon waxes such as polyethylene oxide wax and a block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a fatty acid ester is partially or fully deoxidized such as deoxidized carnauba wax. One of releasing agents may be singly used or a combination of a plurality of releasing agents may be used.

A compatibilizer may optionally be added to the toner cores in order to improve compatibility between the binder resin and the releasing agent.

(Charge Control Agent)

The toner cores may optionally contain a charge control agent. The charge control agent is used, for example, in order to improve the charge stability or the charge rise characteristic of the toner. The charge rise characteristic of the toner is an indicator as to whether the toner can be charged to a specific charge level in a short period of time.

The anionic strength of the toner cores can be increased by causing the toner cores to contain a negatively chargeable charge control agent (more specifically, an organic metal complex, or a chelate compound). The cationic strength of the toner cores can be increased by causing the toner cores to contain a positively chargeable charge control agent (more specifically, pyridine, nigrosine, or a quaternary ammonium salt). However, if the toner is sufficiently chargeable, there is no need to use a charge control agent.

(Magnetic Powder)

The toner cores may optionally contain a magnetic powder. Examples of the material of the magnetic powder that can be preferably used include ferromagnetic metals (more specifically, iron, cobalt, and nickel, or an alloy of at least one of such ferromagnetic metals), ferromagnetic metal oxides (more specifically, ferrite, magnetite, and chromium dioxide), and materials subjected to ferromagnetization (more specifically, carbon materials provided with ferromagnetism by a thermal treatment). One of the magnetic powders may be singly used or a combination of a plurality of the magnetic powders may be used.

The magnetic powder is preferably subjected to a surface treatment in order to inhibit elution of metal ions (for example, iron ions) from the magnetic powder. If a shell layer is formed on the surface of each toner core under acidic conditions, elution of metal ions to the surface of the toner core causes the toner core to adhere to other toner cores more readily. The adhesion of the toner cores to one another can be inhibited by inhibiting the elution of metal ions from the magnetic powder.

[Shell Layer]

The shell layer is bonded (chemically bonded) to the surface of each of the toner cores by, for example, chemically reacting the toner cores with the shell material (the material of the shell layer) in a liquid. The shell layer may be a film with no granular feeling, or a film with granular feeling. In a case where resin particles are used as the material for forming the shell layer, if the material (of the resin particles) has been completely dissolved before curing in the form of a film, the resultant shell layer is probably formed as a film with no granular feeling. On the other hand, if the material (of the resin particles) has not been completely dissolved before curing in the form a film, the resultant shell layer is probably formed as a film in which the resin particles are two-dimensionally arranged (namely, a film with granular feeling).

The shell layer may be made of substantially a thermosetting resin alone, be made of substantially a thermoplastic resin alone, or contain both a thermosetting resin and a thermoplastic resin. If the shell layer contains both a thermosetting resin and a thermoplastic resin, a ratio between the thermoplastic resin and the thermosetting resin in the shell layer is arbitrarily set. The ratio between the thermoplastic resin and the thermosetting resin is, for example, 1:1, 1:2, 1:3, 1:4, 1:5, 2:1, 3:1, 4:1, or 5:1 (in terms of a mass ratio of the thermoplastic resin:the thermosetting resin).

In order to improve the high-temperature preservability of the toner, the shell layer preferably contains any of the resins mentioned in "Preferable Thermosetting Resins" above. In order to improve the charge stability and the high-temperature preservability of the toner, the shell layer particularly preferably contains at least one thermosetting resin selected from the group consisting of melamine-based resins, urea-based resins, and glyoxal-based resins.

In order to improve the charge stability of the toner, the shell layer preferably contains a hydrophobic resin. As the hydrophobic resin contained in the shell layer, any of thermoplastic resin (more specifically, those mentioned in "Preferable Thermoplastic Resins" above) is preferred, and a copolymer of at least one styrene-based monomer (such as a styrene monomer) and at least one acrylic acid-based monomer (such as an acrylic acid ester monomer) is particularly preferred. A styrene-acrylic acid-based resin tends to be more hydrophobic and more easily positively chargeable than a polyester resin.

In order to improve the charge stability of the toner, the shell layer preferably contains, in addition to the hydrophobic resin, a chargeable resin (a resin containing a charge control agent). As the chargeable resin to be contained in the shell layer, a thermoplastic resin in which a repeating unit derived from a positively chargeable charge control agent is incorporated (more specifically, any of those mentioned in "Preferable Thermoplastic Resins" above) is preferred, and a copolymer of a quaternary ammonium compound (such as a quaternary ammonium salt) monomer and an acrylic acid-based monomer (such as an acrylic acid ester monomer) is particularly preferred. Preferable examples of the positively chargeable charge control agent usable in the synthesis of the chargeable resin are as follows. It is noted that derivatives or salts of compounds listed below may be used if necessary.

Preferable examples of the positively chargeable charge control agent includes: azine compounds such as pyridazine, pyrimidine, pyrazine, 1,2-oxazine, 1,3-oxazine, 1,4-oxazine, 1,2-thiazine, 1,3-thiazine, 1,4-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes such as azine fast red FC, azine fast red 12BK, azine violet BO, azine brown 3G, azine light brown GR, azine dark green BH/C, azine deep black EW, and azine deep black 3RL; acid dyes such as nigrosine (more specifically, nigrosine BK, nigrosine NB, or nigrosine Z); metal salts of naphthenic acids or higher organic carboxylic acids; alkoxylated amine; alkyl amide; and quaternary ammonium salts such as benzyl decyl hexyl methyl ammonium chloride, decyl trimethyl ammonium chloride, and 2-(methacryloyloxy)ethyl trimethyl ammonium chloride.

[Hydrophobic Salt]

In the toner of the present embodiment, each toner particle contains, in the surface portion thereof, at least one hydrophobic salt. The surface portion of the toner particle may contain merely one hydrophobic salt alone, or may contain two or more hydrophobic salts. The hydrophobic salt is a compound in a state where a cation derived from the first surfactant is ionically bonded to an anion derived from the second surfactant. As the cation derived from the first surfactant, a cation having a quaternary ammonium cation ($N^+$) is preferred. As the anion derived from the second surfactant, an anion having a sulfate anion group ($—OSO_3^-$) or a sulfonate anion group ($—SO_3^-$) is preferred. In order to suitably synthesize the hydrophobic salt in the surface portion of the toner particle, the hydrophobic salt is preferably synthesized, for example, through ionic bond between a quaternary ammonium cation ($N^+$) of the first surfactant and a sulfate anion group ($—OSO_3^-$) or a sulfonate anion group ($—SO_3^-$) of the second surfactant.

As the first surfactant, cationic surfactants such as an amine salt surfactant and a quaternary ammonium salt surfactant are preferred, and distearyl dimethyl ammonium chloride, lauryl trimethyl ammonium chloride, and stearyl trimethyl ammonium chloride are particularly preferred. In order to inhibit the charge decay of the toner, the cation contained in the hydrophobic salt and derived from the first surfactant preferably has a quaternary ammonium cation, and one or two alkyl groups each having a carbon number of at least 10 and no greater than 30. As the cation contained in the hydrophobic salt and derived from the first surfactant, a distearyl dimethyl ammonium cation, a lauryl trimethyl ammonium cation, or a stearyl trimethyl ammonium cation is particularly preferred.

As the second surfactant, anionic surfactants such as sulfate salts, sulfonic acid salts, phosphate salts, and soap are preferred, and sodium lauryl sulfate, sodium polyoxyethylene lauryl ether sulfate, and sodium lauryl benzene sulfonate are particularly preferred. As the anion contained in the hydrophobic salt and derived from the second surfactant, a lauryl sulfate anion, a polyoxyethylene lauryl ether sulfate anion, and a lauryl benzene sulfonate anion are particularly preferred.

In order to appropriately hydrophobize the surface portion of each toner particle, each of the cation derived from the first surfactant and the anion derived from the second surfactant preferably has an alkyl group having a carbon number of at least 10 and no greater than 30 in the hydrophobic salt.

[External Additive]

An external additive (more specifically, a powder containing a plurality of external additive particles) may optionally be caused to adhere to the surfaces of the toner mother particles. For example, when the external additive (in the form of a powder) is stirred together with the toner mother particles (in the form of a powder), the external additive is caused to adhere (physically bond) to the surfaces of the toner mother particles by physical force. The external additive may be used, for example, in order to improve fluidity or handling property of the toner. The amount of the external additive is preferably 0.5 parts by mass or more and 10 parts by mass or less based on 100 parts by mass of the toner mother particles in order to improve the fluidity or handling property of the toner. In order to improve the fluidity or handling property of the toner, the external additive preferably has a particle size of 0.01 μm or more and 1.0 μm or less.

Silica particles, or particles of a metal oxide (more specifically, alumina, titanium oxide, magnesium oxide, zinc oxide, strontium titanate, or barium titanate) are preferably used as the external additive particles. One of such external additives may be singly used or a plurality of external additives may be used.

[Method for Producing Toner]

Now, an example of a method for producing the toner having the above-described features will be described. First, anionic toner cores are prepared. Subsequently, the toner cores, a shell material, and an anionic surfactant are added to an aqueous medium. Preferably, the shell material is dissolved or dispersed in the aqueous medium by, for example, stirring. Then, the shell material is formed into a film in the aqueous medium to form a shell layer (a cured film) on the surface of each toner core. As a result, toner mother particles are obtained. Subsequently, a cationic surfactant is added to the aqueous medium, and the cationic surfactant is caused to ionically bond to the anionic surfactant adhering to the surfaces of the toner mother particles, and thus, a hydrophobic salt is synthesized on the surfaces of the toner mother particles. In this manner, the toner mother particles having the hydrophobic salt in surface portions thereof can be obtained.

In order to inhibit toner core components (a binder resin and a releasing agent in particular) from dissolving or eluting in forming the shell layer, the shell layer is formed preferably in an aqueous medium. The aqueous medium is a medium containing water as a main component (more specifically, pure water, or a mixed liquid of water and a polar medium). The aqueous medium may be allowed to function as a solvent. The aqueous medium may contain a solute dissolved therein. The aqueous medium may be allowed to function as a dispersion medium. The aqueous medium may contain a dispersoid dispersed therein. The polar medium possibly contained in the aqueous medium can be an alcohol (more specifically, methanol or ethanol).

The method for producing the toner of the present embodiment will now be described in more details with reference to more specific examples.

(Preparation of Toner Cores)

In order to easily obtain preferable toner cores, the toner cores are prepared preferably by an aggregation method or a pulverization method, and more preferably by the pulverization method.

An example of the pulverization method will now be described. First, a binder resin, an internal additive (for example, at least one of a colorant, a releasing agent, a charge control agent, and a magnetic powder) are mixed. The resultant mixture is then melted and kneaded. Next, the resultant melt-kneaded product is pulverized and then classified. In this manner, toner cores having a desired particle size are prepared.

An example of the aggregation method will now be described. First, a binder resin, a releasing agent, and a colorant all in the form of fine particles are caused to aggregate in an aqueous medium to form aggregated particles containing components of the binder resin, the releasing agent, and the colorant. Subsequently, the resultant aggregated particles are heated to cause coalescence of the components contained in the aggregated particles. As a result, a dispersion of toner cores is obtained. Thereafter, unnecessary substances (a surfactant and the like) are removed from the dispersion of the toner cores to produce the toner cores.

(Formation of Shell Layer)

For example, ion-exchanged water is prepared as an aqueous medium. Subsequently, the pH of the resultant liquid is controlled to a prescribed pH (hereinafter referred to as the controlled pH) using, for example, hydrochloric acid. The controlled pH is preferably at least 3 and no greater than 5 (weakly acid) in order to promote the formation of a shell layer.

Subsequently, the toner cores, a suspension of a hydrophobic resin (a liquid containing hydrophobic resin particles), and an anionic surfactant are added to the liquid having the controlled pH (for example, an acidic aqueous medium). As the hydrophobic resin, for example, a copolymer of at least one styrene-based monomer and at least one acrylic acid-based monomer can be used. In order to improve the film quality of the shell layer, the hydrophobic resin particles have a number average particle size of, preferably 25 nm or more and 40 nm or less. If the toner cores are anionic, the aggregation of the toner cores can be inhibited by using the anionic surfactant having the same polarity. Examples of the anionic surfactant include sulfate salts, sulfonic acid salts, phosphate salts, and soap. Besides, a material for synthesizing a chargeable resin and/or a thermosetting resin may be added to the liquid if necessary.

The shell material and the like may be added to the liquid at room temperature, or to the aqueous medium having a temperature controlled to a prescribed temperature. An appropriate additive amount of the shell material can be calculated based on the specific surface area of the toner cores. A polymerization accelerator may be optionally added to the liquid in addition to the shell material and the like.

Preferably, the toner cores are highly dispersed in the liquid containing the shell material in order to uniformly attach the shell material to the surfaces of the toner cores. In order to highly disperse the toner cores in the liquid, the liquid may contain a dispersant or be stirred using a stirring device having strong power (for example, "Hivis Disper Mix" manufactured by PRIMIX Corporation).

Subsequently, the liquid containing the shell material and the like is increased, under stirring, in temperature up to a prescribed retention temperature (for example, a temperature of at least 50° C. and no greater than 85° C.) at a predetermined rate (for example, a rate of at least 0.1° C./min and no greater than 3° C./min) The temperature of the liquid is then maintained at the retention temperature for a prescribed time period (for example, at least 30 minutes and no greater than 4 hours) under stirring. While the liquid is being maintained at a high temperature, the shell material adheres to the surfaces of the toner cores, and a chemical reaction is caused between the toner cores and the shell material. As a result, the shell layer in the form of a film substantially constituted by the resin is cured on the surface of each toner core. The shell material (i.e., the resin in the form of particles) is regarded to be dissolved in the liquid and cured in the form of a film. If the shell material (the resin particles) is completely dissolved before curing in the form of a film, a film with no granular feeling is probably formed as the shell layer. On the other hand, if the shell material (the resin particles) is not completely dissolved before curing in the form of a film, a film in a form where the resin particles are two-dimensionally arranged (a film with granular feeling) is probably formed as the shell layer. Since the shell layer is thus formed on the surface of each of the toner cores in the liquid, a dispersion of toner mother particles before hydrophobization is obtained. In the thus obtained dispersion, the anionic surfactant adheres to the surface of the shell layer.

Subsequently, the resultant liquid is cooled to normal temperature (of approximately 25° C.). Then, a cationic surfactant is added to the liquid under stirring. As the cationic surfactant, for example, an amine salt surfactant or a quaternary ammonium salt surfactant can be used. When a cation derived from the cationic surfactant and an anion derived from the anionic surfactant are mutually ionically bonded in the liquid, a hydrophobic salt is synthesized on the surface of each of the toner mother particles. As a result, a dispersion of the toner mother particles each containing the hydrophobic salt in a surface portion thereof (namely, hydrophobized toner mother particles) is obtained. Since the cationic surfactant is added to the aqueous medium, the anionic surfactant having attached to the surfaces of the toner mother particles is changed into the hydrophobic salt, and a portion of the anionic surfactant remaining to be dissolved in the aqueous medium is probably removed by solid-liquid separation described later.

In order to inhibit elution of the toner core components or deformation of the toner cores, the retention temperature (i.e., the temperature of the liquid at which the shell layer is formed) is preferably below the glass transition point (Tg) of the toner cores. However, the toner cores may be forcedly deformed by setting the retention temperature to be at least the glass transition point (Tg) of the toner cores. High retention temperature can promote deformation of the toner cores, and as a result, the shape of each toner mother particle tends to approximate to a true sphere. It is desirable to control the retention temperature so that the toner mother particles have a desired shape. When the shell material is caused to react at a high temperature, the shell layer tends to be hard.

After hydrophobizing the surfaces of the toner mother particles as described above, the dispersion of the toner mother particles is neutralized using, for example, sodium hydroxide. The dispersion of the toner mother particles is then cooled to, for example, normal temperature. Subsequently, the dispersion of the toner mother particles is filtrated using, for example, a Buchner funnel. In this manner, the toner mother particles are separated (solid-liquid separated) from the liquid to collect a wet cake of the toner mother particles. The collected wet cake of the toner mother particles was then washed. Subsequently, the washed toner mother particles are dried. Thereafter, if necessary, the toner mother particles and an external additive may be mixed using a mixer (for example, an FM mixer manufactured by Nippon Coke & Engineering Co., Ltd.) to cause the external additive to adhere to the surfaces of the toner mother particles. If a spray dryer is used in the drying process, the drying process and the external addition process can be carried out simultaneously by spraying a dispersion of an external additive (such as silica particles) toward the toner mother particles. In this manner, a toner including a large number of toner particles is produced.

The contents and the order of the processes in the method for producing the toner described above may be altered as appropriate in accordance with requirements of the toner, such as in terms of composition and properties. For example, the pH of the liquid (for example, the aqueous medium) may be controlled before or after the shell material and the like (the shell material, the toner cores, and the surfactant) are added to the liquid. The shell material and the like may be added altogether at one time or separately. Besides, before adding the shell material and the like to the liquid, the liquid may be heated to the retention temperature. Furthermore, if a material (for example, the shell material) is caused to react in the liquid, the material may be caused to react in the liquid for a predetermined time period after the material is added to the liquid. Alternatively, the material may be caused to react in the liquid while being added to the liquid over long time. The shell material may be added to the liquid at one time or in plural times. The shell layer may be formed by any method. For example, the shell layer may be formed by an in-situ polymerization method, a film formation method by curing in a liquid, or a coacervation method. The toner may be sifted after the external addition process. Non-essential processes may alternatively be omitted. For example, if a commercially available product can be directly used as a material, the commercially available product can be used to omit a process for preparing the material. If there is no need to use an external additive, the external addition process may be omitted. If an external additive is not caused to adhere to the surfaces of the toner mother particles (namely, the external addition process is omitted), the toner mother particles and the toner particles are equivalent. A prepolymer may be used instead of the monomer. Besides, in order to obtain any of the above-described compounds, a salt, an ester, a hydrate, or an anhydride of the compound may be used as a raw material. The respective materials may be used in a solid state or a liquid state. For example, a powdery material in a solid state may be used. Alternatively, a solution of a material (the material in a liquid state dissolved in a solvent) may be used or a dispersion of a material (a liquid in which the material in a solid state is dispersed) may be used. In order to efficiently produce the toner, preferably a large number of toner particles are produced at the same time.

EXAMPLES

Examples of the present disclosure will now be described. Table 1 shows toners A to L (electrostatic latent image developing toners) according to examples and comparative examples.

TABLE 1

| | Anionic Surfactant | | Cationic Surfactant | | Hydrophobic |
|---|---|---|---|---|---|
| Toner | Hydrophobic Group | Hydrophilic Group | Hydrophobic Group | Hydrophilic Group | salt content (ppm) |
| A | $C_{12}H_{25}$— | —$OSO_3^-$ | $C_{18}H_{37}$—/ | —$N(CH_3)_2^+$— | 4000 |
| B | $C_{12}H_{25}$— | —$OSO_3^-$ | —$C_{18}H_{37}$ | | 2200 |
| C | $C_{12}H_{25}$—$C_6H_4$— | —$SO_3^-$ | | | 3200 |
| D | $C_{12}H_{25}$— | —$OSO_3^-$ | $C_{12}H_{25}$— | —$N(CH_3)_3^+$ | 3600 |
| E | | | $C_{18}H_{37}$— | —$N(CH_3)_3^+$ | 3400 |
| F | | | | | 40 |
| G | | | | | 400 |
| H | $C_{12}H_{25}$— | —$OSO_3^-$ | — | — | 0 |
| I | — | — | $C_{18}H_{37}$—/ —$C_{18}H_{37}$ | —$N(CH_3)_2^+$— | 0 |
| J | | | $C_{12}H_{25}$— | —$N(CH_3)_3^+$ | 0 |
| K | $C_{12}H_{25}$— | —$OSO_3^-$ | $C_{18}H_{37}$—/ —$C_{18}H_{37}$ | —$N(CH_3)_2^+$— | 8000 |
| L | | | $C_{12}H_{25}$— | —$N(CH_3)_3^+$ | 9600 |

Production methods of the respective toners A to L (electrostatic latent image developing toners), evaluation methods, and evaluation results are successively described below. An evaluation result (i.e., a value corresponding to the shape or physical property) of a powder containing a plurality of particles (more specifically, toner cores, toner mother particles, an external additive, a toner or the like) is, unless otherwise specified, a number average of values measured for an appropriate number of average particles selected from the powder. In an evaluation in which errors may occur, an evaluation value was calculated by calculating the arithmetic mean of an appropriate number of measured values in order to ensure that any errors were sufficiently small. A measured value of the number average particle size of a powder is, unless otherwise specified, a circle equivalent diameter (i.e., a diameter of a circle having the same area as a projected area of a particle) of a particle measured with a transmission electron microscope (TEM). Besides, a measured value of a volume median diameter ($D_{50}$) of a powder is, unless otherwise specified, a value obtained through measurement with "Coulter Counter Multisizer 3" manufactured by Beckman Coulter, Inc. Methods for measuring a glass transition point (Tg) and a softening point (Tm) are as follows unless otherwise specified.

<Method for Measuring Glass Transition Point (Tg)>

A heat absorption curve (ordinate: heat flow (DSC signal), abscissa: temperature) of a sample (for example, a resin) was plotted using a differential scanning calorimeter ("DSC-6220" manufactured by Seiko Instruments Inc.). Subsequently, the glass transition point (Tg) of the sample was read from the plotted heat absorption curve. The glass transition point (Tg) of the sample is a temperature on the plotted heat absorption curve corresponding to a point of variation of the specific heat (an intersection point of an extrapolated baseline and an extrapolated fall line).

<Method for Measuring Softening Point (Tm)>

An S-shaped curve (abscissa: temperature, ordinate: stroke) of a sample (for example, a resin) was plotted by placing the sample in a capillary rheometer ("CFT-500D" manufactured by Shimadzu Corporation) and causing melt-flow of 1 $cm^3$ of the sample under conditions of a die pore diameter of 1 mm, a plunger load of 20 $kg/cm^2$, and a heating rate of 6° C./min Subsequently, the softening point (Tm) of the sample was read from the plotted S-shaped curve. The softening point (Tm) of the sample is a temperature on the plotted S-shaped curve corresponding to a stroke value of $(S_1+S_2)/2$, where $S_1$ represents a maximum stroke value and $S_2$ represents a baseline stroke value at low temperatures.

[Method for Producing Toner A]

(Preparation of Toner Core)

An FM mixer (manufactured by Nippon Coke & Engineering Co., Ltd.) was used to mix 750 g of a low-viscosity polyester resin (Tg=38° C., Tm=65° C.), 100 g of an intermediate-viscosity polyester resin (Tg=53° C., Tm=84° C.), 150 g of a high-viscosity polyester resin (Tg=71° C., Tm=120° C.), 55 g of a carnauba wax ("Carnauba Wax No. 1" manufactured by S. KATO & CO.), and 40 g of a colorant (phthalocyanine blue, "KET BLUE 111" produced by DIC Corporation) at a rotational speed of 2,400 rpm.

Subsequently, the resultant mixture was melt-knead using a twin-screw extruder ("PCM-30" manufactured by Ikegai Corp.) under conditions of a material input rate of 5 kg/hour, a shaft rotational speed of 160 rpm, and a temperature setting range (cylinder temperature) of 100° C. or higher and 130° C. or lower. The resultant melt-knead product was cooled, and the cooled melt-knead product was coarsely pulverized using a pulverizer ("Rotoplex (registered Japanese trademark)" manufactured by Hosokawa Micron Corporation). Next, the coarsely pulverized product was finely pulverized using a jet mill ("Supersonic Jet Mill I" manufactured by Nippon Pneumatic Mfg. Co., Ltd.). The finely pulverized product was then classified using a classifier ("Elbow Jet EJ-LABO" manufactured by Nittetsu Mining Co., Ltd.). In this manner, toner cores having a volume median diameter ($D_{50}$) of 6 μm were prepared.

(Preparation of Shell Material)

A 1-L three-necked flask equipped with a thermometer and a stirring impeller was set in a water bath at 30° C. Then, 875 mL of ion-exchanged water and 75 mL of an anionic surfactant ("LATEMUL (registered Japanese trademark) WX" manufactured by Kao Corporation, component: sodium polyoxyethylene alkyl ether sulfate, solid concentration: 26% by mass) were added into the flask. Subsequently, the internal temperature of the flask was increased to 80° C. using the water bath. Next, two liquids (a first liquid and a second liquid) were added dropwise over 5 hours each to the flask contents at a temperature of 80° C. The first liquid was a mixed liquid of 17 mL of styrene and 3 mL of butyl acrylate. The second liquid was a solution of 0.5 g of potassium persulfate dissolved in 30 mL of ion-exchanged water. The internal temperature of the flask was then maintained at 80° C. for additional 2 hours for polymerization of the flask contents. As a result, a suspension (hereinafter referred to as the suspension A) of resin particulates (hydrophobic resin) was prepared. The resin particulates contained in the prepared suspension A had a number average particle size of 32 nm and a glass transition point (Tg) of 71° C.

(Shell Layer Formation Process)

A 1-L three-necked flask equipped with a thermometer and a stirring impeller was set in a water bath, and 450 mL of ion-exchanged water was added into the flask. Subsequently, the internal temperature of the flask was maintained at 30° C. using the water bath. Then, 150 mL of the suspension A, 300 g of the toner cores prepared through the above-described process, 1.5 g of an anionic surfactant ("EMAL (registered Japanese trademark) 10PT" manufactured by Kao Corporation, component: sodium lauryl sulfate) were added into the flask. Then, the flask contents were stirred for 1 hour at a rotational speed of 200 rpm. Thereafter, 300 mL of ion-exchanged water was added into the flask.

Subsequently, the internal temperature of the flask was increased up to 70° C. at a rate of 1° C./min under stirring at a rotation speed of 100 rpm. Then, the flask contents were stirred for 2 hours under conditions of a temperature of 70° C. and a rotational speed of 100 rpm.

Thereafter, the flask contents were cooled to normal temperature (approximately 25° C.). Then, 1.4 g of a cationic surfactant ("QUARTAMIN (registered Japanese trademark) D86P" manufactured by Kao Corporation, component: distearyl dimethyl ammonium chloride) was slowly added into the flask with stirring. Thus, a dispersion of toner mother particles each containing a hydrophobic salt in a surface portion thereof was prepared.

(Washing Process)

A wet cake of the toner mother particles was collected from the dispersion of the toner mother particles obtained as described above by filtration (solid-liquid separation) using a Buchner funnel. Thereafter, the collected wet cake of the toner mother particles was re-dispersed in ion-exchanged water. Furthermore, dispersion and filtration were repeated five times for washing the toner mother particles.

(Drying Process)

Subsequently, the resultant toner mother particles were dispersed in an aqueous solution of ethanol at a concentration of 50% by mass. As a result, a slurry of the toner mother particles was prepared. Next, the prepared slurry was then fed into a continuous type surface modifier ("Coatmizer (registered Japanese trademark)" manufactured by Freund Corporation) to dry the toner mother particles in the slurry under conditions of a hot air temperature of 45° C. and a blower air flow rate of 2 $m^3$/min. As a result, a powder of toner mother particles was obtained.

(External Addition Process)

Subsequently, the resultant toner mother particles were subjected to the external addition process. Specifically, a 10-L FM mixer (manufactured by Nippon Coke & Engineering Co., Ltd.) was used to mix 100 parts by mass of the toner mother particles and 1.0 part by mass of dry silica particulates (i.e., silica particles having been positively charged through a surface treatment: "AEROSIL (registered Japanese trademark) REA 90" manufactured by Nippon Aerosil Co., Ltd.) for 5 minutes to cause the external additive (the silica particles) to adhere to the surfaces of the toner mother particles. Thereafter, the resultant powder was sifted using a 200 mesh (opening 75 μm) sieve to yield a toner A including a large number of toner particles.

[Method for Producing Toner B]

The toner B was produced in the same manner as the toner A except that 1.5 g of the anionic surfactant (EMAL 10PT) was replaced, in the shell layer formation process, with 2.1 g of an anionic surfactant ("EMAL 20C" manufactured by Kao Corporation, component: sodium polyoxyethylene lauryl ether sulfate).

[Method for Producing Toner C]

The toner C was produced in the same manner as the toner A except that 1.5 g of the anionic surfactant (EMAL 10PT) was replaced, in the shell layer formation process, with 0.8 g of an anionic surfactant ("NEOPELEX (registered Japanese trademark) G-25" manufactured by Kao Corporation, component: sodium lauryl benzene sulfonate).

[Method for Producing Toner D]

The toner D was produced in the same manner as the toner A except that 1.4 g of the cationic surfactant (QUARTAMIN D86P) was replaced, in the shell layer formation process, with 1.1 g of a cationic surfactant ("QUARTAMIN 24P" manufactured by Kao Corporation, component: lauryl trimethyl ammonium chloride).

[Method for Producing Toner E]

The toner E was produced in the same manner as the toner A except that 1.4 g of the cationic surfactant (QUARTAMIN D86P) was replaced, in the shell layer formation process, with 1.2 g of a cationic surfactant ("QUARTAMIN 86W" manufactured by Kao Corporation, component: stearyl trimethyl ammonium chloride).

[Method for Producing Toner F]

The toner F was produced in the same manner as the toner E except that the amount of the cationic surfactant (QUARTAMIN D86P) used in the shell layer formation process was changed from 1.2 g to 0.01 g.

[Method for Producing Toner G]

The toner G was produced in the same manner as the toner E except that the amount of the cationic surfactant (QUARTAMIN D86P) used in the shell layer formation process was changed from 1.2 g to 2.4 g.

[Method for Producing Toner H]

The toner H was produced in the same manner as the toner A except that 1.4 g of the cationic surfactant (QUARTAMIN D86P) was not used in the shell layer formation process.

[Method for Producing Toner I]

The toner I was produced in the same manner as the toner A except that 1.5 g of the anionic surfactant (EMAL 10PT)

was replaced, in the shell layer formation process, with 1.4 g of a cationic surfactant ("QUARTAMIN D86P" manufactured by Kao Corporation, component: distearyl dimethyl ammonium chloride).

[Method for Producing Toner J]

The toner J was produced in the same manner as the toner A except that 1.5 g of the anionic surfactant (EMAL 10PT) was replaced, in the shell layer formation process, with 1.4 g of a cationic surfactant ("QUARTAMIN 24P" manufactured by Kao Corporation, component: lauryl trimethyl ammonium chloride).

[Method for Producing Toner K]

The toner K was produced in the same manner as the toner A except that the amount of the cationic surfactant (QUARTAMIN D86P) used in the shell layer formation process was changed from 1.4 g to 2.8 g.

[Method for Producing Toner L]

The toner L was produced in the same manner as the toner A except that 1.4 g of the cationic surfactant (QUARTAMIN D86P) was replaced, in the shell layer formation process, with 2.8 g of a cationic surfactant ("QUARTAMIN 24P" manufactured by Kao Corporation, component: lauryl trimethyl ammonium chloride).

[Evaluation Methods]

Each of the samples (of the toners A to L) was evaluated as follows.

(Hydrophobic Salt Content)

A vessel of a disperser ("ARE-310" manufactured by Thinky Corporation) was charged with 2 g of the sample (toner) and 20 g of methanol, and the temperature of the vessel contents was maintained at 25° C. Subsequently, the vessel contents were dispersed using the disperser for 30 minutes. As a result, a dispersion containing the sample was obtained.

Then, a centrifuge ("3740" manufactured by Kubota Manufacturing Corporation) was used to subject the dispersion of the sample to centrifugation at a rotational speed of 8,000 rpm for 30 minutes. A supernatant was collected from the resultant centrifuged liquid.

Subsequently, the thus obtained supernatant was subjected to liquid chromatography to obtain a chromatogram. With the hydrophobic salt dissolved in an eluent, the amount of an ion (either of an anion or a cation) eluted in the eluent was measured. A precedently created calibration curve was used for obtaining, on the basis of the area of a peak peculiar to the ion included in the chromatogram, the amount (in ppm) of the hydrophobic salt corresponding to the ion. The liquid chromatography was performed under the following conditions:

<Conditions of Liquid Chromatography>

Differential refractometer: "Shodex RI (registered Japanese trademark) manufactured by Showa Denko K.K.)

Detection wavelength: 254 nm

Column: "Asahipak (registered Japanese trademark) GF-310 HQ" manufactured by Showa Denko K.K.

Column temperature: 40° C.

Eluent: Mixed solvent of 50 mM $NaNO_3$ aqueous solution and acetonitrile ($CH_3CN$) (in a volume ratio of 50/50)

Flow rate: 1.0 mL/min

Injection amount: 50 μL

Incidentally, not only a hydrophobic salt (hereinafter referred to as the first hydrophobic salt) derived from the anionic surfactant (such as EMAL 10PT used in the production of the toner A) used in the shell layer formation process but also a hydrophobic salt (hereinafter referred to as the second hydrophobic salt) derived from the anionic surfactant (such as LATEMUL WX used in the production of the toner A) used in the preparation of the shell material was present on the surface of each toner particle. The amount of the second hydrophobic salt was, however, extremely small as compared with the amount of the first hydrophobic salt (for example, 1/100 or less in the toner A), and therefore, the amount of the first hydrophobic salt alone will be herein mentioned. Each hydrophobic salt content shown in Table 1 corresponds to the amount of the first hydrophobic salt.

(High-Temperature Preservability)

A 20-mL polyethylene vessel was charged with 2 g of the sample (the toner), and the vessel was left for 3 hours in a thermostatic chamber set to 60° C. Thus, an evaluation toner was prepared in the vessel.

Next, the evaluation toner was placed on a 100 mesh (opening 150 μm) sieve of known mass. The mass of the sieve including the evaluation toner put thereon was measured in order to obtain the mass of the evaluation toner placed on the sieve (i.e., the toner mass pre-sifting). Next, the sieve was set in a powder tester (manufactured by Hosokawa Micron Corporation) and was caused to vibrate in accordance with a manual of the powder tester at a rheostat level of 5 for 30 seconds in order to sift the evaluation toner. After sifting, the mass of toner that did not pass through the sieve (the toner mass post-sifting) was measured by measuring the mass of the sieve including the remaining toner thereon. Then, a degree of aggregation (in % by mass) of the sample (the toner) was calculated in accordance with the following equation:

$$\text{Degree of aggregation (\% by mass)} = 100 \times \text{toner mass post-sifting/toner mass pre-sifting}$$

If the toner had a degree of aggregation of 10% by mass or less, it was evaluated as good, and if the toner had a degree of aggregation exceeding 10%, it was evaluated as poor.

(Fixability)

A developer (two-component developer) for evaluation use was prepared by mixing 100 parts by mass of a developer carrier (carrier for "TASKalfa5550ci" manufactured by KYOCERA Document Solutions Inc.) and 10 parts by mass of the sample (the toner) for 30 minutes using a ball mill.

A color printer ("FS-C5250DN" manufactured by KYOCERA Document Solutions Inc., modified to form a testing apparatus having adjustable fixing temperature) was used as a testing apparatus. The evaluation developer prepared as described above was loaded into a developing device of the testing apparatus and the sample (supplement toner) was loaded into a toner container of the testing apparatus.

The testing apparatus was used to form a solid image with a size of 25 mm×25 mm on 90 g/m$^2$ paper (A4 size evaluation paper) under conditions of a linear speed of 200 mm/s and a toner application amount of 1.0 mg/cm$^2$. Next, the paper having the image formed thereon was passed through a fixing device. On the paper having passed through the fixing device, occurrence of offset was visually checked. The fixing temperature was set in a range of 100° C. or higher and 200° C. or lower. The fixing temperature of the fixing device was increased from 100° C. by 5° C. If the toner adhered to a fixing roller, it was determined that the offset occurred. A lowest temperature (a lowest fixing temperature) and a highest temperature (a highest fixing temperature), within the above-described range of the fixing temperature, at which the offset did not occur were respectively measured. Besides, on the basis of the measured lowest fixing temperature and highest fixing temperature, a fixing region (=the highest fixing temperature−the lowest fixing temperature) was obtained.

If the toner had a fixing region of 30° C. or more, it was evaluated as good, and if the toner had a fixing region lower than 30° C., it was evaluated as poor.

(Resistance to Drum Adhesion)

An evaluation developer (two-component developer) was prepared in the same manner as in the evaluation of the fixability. A color printer ("FS-C5400DN" manufactured by KYOCERA Document Solutions Inc.) was used as a testing apparatus. The evaluation developer was loaded into a developing device of the testing apparatus and the sample (supplement toner) was loaded into a toner container of the testing apparatus.

A printing durability test was carried out by using the testing apparatus to print 10,000 sheets with a coverage of 5% under an environment of a temperature of 32° C. and a humidity of 80% RH. It was evaluated whether or not the toner adhered to a photosensitive drum during the printing durability test. More specifically, if dash mark was not observed in a formed solid image, the toner was evaluated as good, and if dash mark was observed in the solid image, the toner was evaluated as poor. It is noted that dash mark refers to an image defect caused when a toner adheres to the surface of a photosensitive drum.

(Charge Decay Constant)

A charge decay constant of the sample (the toner) was measured in accordance with JIS (Japan Industrial Standard) C 61340-2-1-2006 using an electrostatic diffusivity measuring device ("NS-D100" manufactured by Nano Seeds Corporation). A method for measuring the charge decay constant of the toner will now be described.

The sample (the toner) was placed into a measurement cell. The measurement cell was a metal cell with a recess having an inner diameter of 10 mm and a depth of 1 mm. The sample was filled in the recess of the cell by being thrust from above using a glass slide. A portion of the sample brimming over the cell was removed by reciprocating the glass slide on the surface of the cell. At least 0.04 g and no greater than 0.06 g of sample was filled in the cell.

Subsequently, the measurement cell in which the sample was filled was left for 12 hours in an environment of a temperature of 32° C. and a humidity of 80% RH. Thereafter, the measurement cell was grounded and placed in the electrostatic diffusivity measuring device. Ions were then supplied to the sample through corona discharge to charge the sample. The charging period was 0.5 second. After elapse of 0.7 second from completion of the corona discharge, the surface potential of the sample was measured continuously. The charge decay constant (charge decay rate) $\alpha$ was calculated based on the measured surface potential and an equation $V=V_0\exp(-\alpha\sqrt{t})$. In the equation, V represents a surface potential [V], $V_0$ represents an initial surface potential [V], and t represents a decay period [second].

If the toner had a charge decay coefficient of 0.020 or less, it was evaluated as good, and if the toner had a charge decay coefficient exceeding 0.020, it was evaluated as poor.

Table 2 shows the evaluation results (Heat-resistance Storage Stability: degree of aggregation, Fixability: fixing region (the lowest fixing temperature, the highest fixing temperature), Resistance to Drum Adhesion: presence of dash mark, Charge Decay Characteristic: charge decay coefficient) of the toners A to L. It is noted that the measurement results of the hydrophobic salt content are shown in Table 1.

TABLE 2

| | Toner | High-temperature preservability [% by mass] | Fixability [° C.] | Resistance to Drum Adhesion | Charge Decay |
|---|---|---|---|---|---|
| Example 1 | A | 7 | 40 (135, 175) | Good | 0.010 |
| Example 2 | B | 5 | 40 (135, 175) | Good | 0.014 |
| Example 3 | C | 4 | 40 (135, 175) | Good | 0.008 |
| Example 4 | D | 6 | 35 (140, 175) | Good | 0.007 |
| Example 5 | E | 6 | 35 (140, 175) | Good | 0.011 |
| Example 6 | F | 2 | 35 (140, 175) | Good | 0.015 |
| Example 7 | G | 3 | 35 (140, 175) | Good | 0.015 |
| Comparative Example 1 | H | 2 | 25 (135, 160) Poor | Good | 0.028 (Poor) |
| Comparative Example 2 | I | 2 | 25 (135, 160) Poor | Good | 0.026 (Poor) |
| Comparative Example 3 | J | 4 | 25 (135, 160) Poor | Good | 0.030 (Poor) |
| Comparative Example 4 | K | 21 (Poor) | 40 (135, 175) | Poor | 0.042 (Poor) |
| Comparative Example 5 | L | 33 (Poor) | 35 (140, 175) | Poor | 0.046 (Poor) |

Each of the toners A to G (the toners according to Examples 1 to 7) had the above-described basic features. More specifically, in each of the toners of Examples 1 to 7, each of the toner particles (more specifically, each of the toner mother particles) contained, in a surface portion thereof, at least one hydrophobic salt in a state where a cation (a distearyl dimethyl ammonium cation, a lauryl trimethyl ammonium cation, or a stearyl trimethyl ammonium cation) derived from a first surfactant (more specifically, distearyl dimethyl ammonium chloride, lauryl trimethyl ammonium chloride, or stearyl trimethyl ammonium chloride) was ionically bonded to an anion (a lauryl sulfate anion, a polyoxyethylene lauryl ether sulfate anion, or a lauryl benzene sulfonate anion) derived from a second surfactant (more specifically, sodium lauryl sulfate, sodium polyoxyethylene lauryl ether sulfate, or sodium lauryl benzene sulfonate). In each of the toners of Examples 1 to 7, the hydrophobic salt content (the ratio of the total mass of the at least one hydrophobic salt to the mass of the toner) was 1 ppm or more and 5,000 ppm or less.

Each of the toners of Examples 1 to 7 could be produced using a hydrophobic surfactant. Besides, as shown in Table 2, each of the toners of Examples 1 to 7 was excellent in the high-temperature preservability and the low-temperature fixability, and the charge decay was difficult to occur therein even under a high-humidity environment. Furthermore, when an image was formed by using each of the toners of Examples 1 to 7, the toner was difficult to attach to a photosensitive drum.

What is claimed is:

1. An electrostatic latent image developing toner comprising a plurality of toner particles, wherein each of the toner particles contains, in a surface portion thereof, at least one hydrophobic salt in a state where a quaternary ammonium cation group of a cationic surfactant is ionically bonded to a sulfate anion group or a sulfonate anion group of an anionic surfactant, and a ratio of a total mass of the at least one hydrophobic salt to a mass of the toner is 1 ppm or more and 5,000 ppm or less.

2. The electrostatic latent image developing toner according to claim 1, comprising, as the toner particles, a plurality of toner particles each including a core and a shell layer disposed over a surface of the core, wherein the hydrophobic salt is contained in a surface portion of the shell layer.

3. The electrostatic latent image developing toner according to claim 2, wherein the core contains a polyester resin, and the hydrophobic salt is contained in a surface portion of the core in a region where a surface of the core is not covered by the shell layer.

4. The electrostatic latent image developing toner according to claim 2, wherein the shell layer contains a copolymer of at least one styrene-based monomer and at least one acrylic acid-based monomer.

5. The electrostatic latent image developing toner according to claim 1, wherein the cationic surfactant has one or two alkyl groups each having a carbon number of at least 10 and no greater than 30.

6. The electrostatic latent image developing toner according to claim 1, wherein the cationic surfactant is a distearyl dimethyl ammonium cation, a lauryl trimethyl ammonium cation, or a stearyl trimethyl ammonium cation.

7. The electrostatic latent image developing toner according to claim 6, wherein the anionic surfactant is a lauryl sulfate anion, a polyoxyethylene lauryl ether sulfate anion, or a lauryl benzene sulfonate anion.

8. The electrostatic latent image developing toner according to claim 1, wherein each of the cationic surfactant and the anionic surfactant of the hydrophobic salt has an alkyl group having a carbon number of at least 10 and no greater than 30.

9. The electrostatic latent image developing toner according to claim 1, wherein the ratio of the total mass of the at least one hydrophobic salt to the mass of the toner is 1 ppm or more and 1,000 ppm or less.

10. The electrostatic latent image developing toner according to claim 1, wherein the at least one hydrophobic salt is a compound in a state where a quaternary ammonium cation group of a distearyl dimethyl ammonium cation represented by formula (A) shown below is ionic ally bonded to a sulfate anion group of a lauryl sulfate anion represented by formula (B) shown below (A)

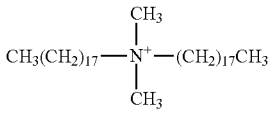

(B)

11. The electrostatic latent image developing toner according to claim 3, wherein the shell layer covers 70% or more and 95% or less of a surface area of the core.

* * * * *